United States Patent [19]

Collins

[11] 3,966,214

[45] June 29, 1976

[54] TILT TOP GOLF TEE

[76] Inventor: Dalford D. Collins, 2016 Walnut St., Hastings, Minn. 55033

[22] Filed: May 27, 1975

[21] Appl. No.: 580,878

[52] U.S. Cl. ..... 273/207

[51] Int. Cl.[2] ..... A63B 57/00

[58] Field of Search ..... 273/207, 33, 206, 201, 273/202, 203, 208, 209, 211, 212

[56] References Cited

UNITED STATES PATENTS

| | | | |
|---|---|---|---|
| 2,839,304 | 6/1958 | Lerick | 273/207 |
| 3,414,268 | 12/1968 | Chase | 273/211 |

*Primary Examiner*—Richard C. Pinkham
*Assistant Examiner*—T. Brown
*Attorney, Agent, or Firm*—Dorsey, Windhorst, Hannaford, Whitney & Halladay

[57] ABSTRACT

An improved, reuseable golf tee comprising a shank element and a head element connected with each other for relative limited pivotal movement. The head element includes a ball supporting portion threadedly connected with a shank retaining portion such that tightening of the threaded connection restricts the freedom of such pivotal movement between the head and shank elements.

10 Claims, 11 Drawing Figures

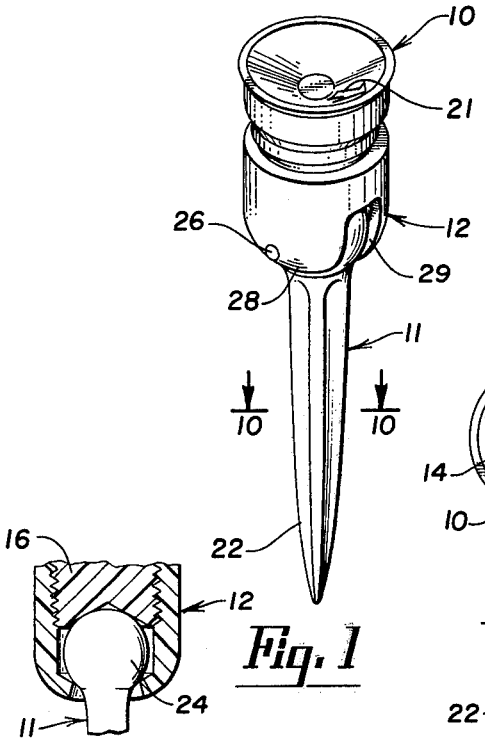
Fig. 1
Fig. 11
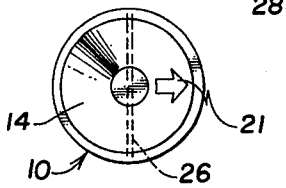
Fig. 5
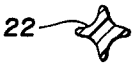
Fig. 10
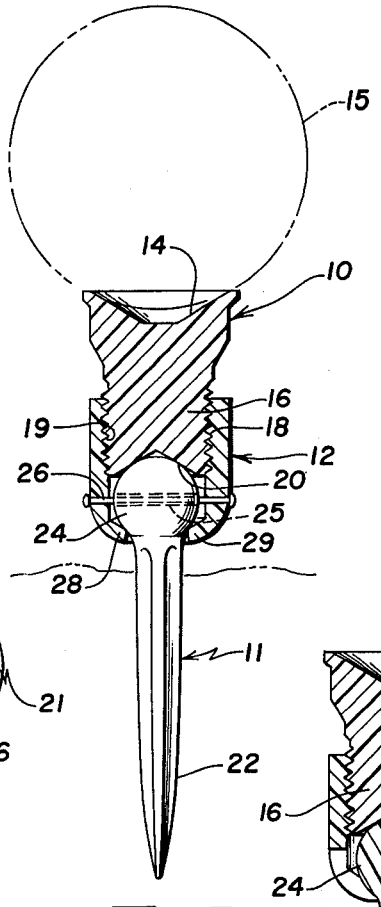
Fig. 2
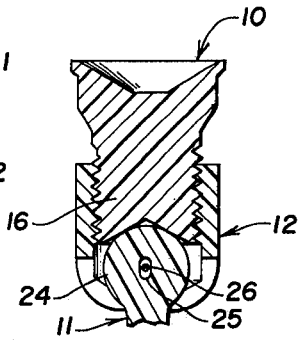
Fig. 9
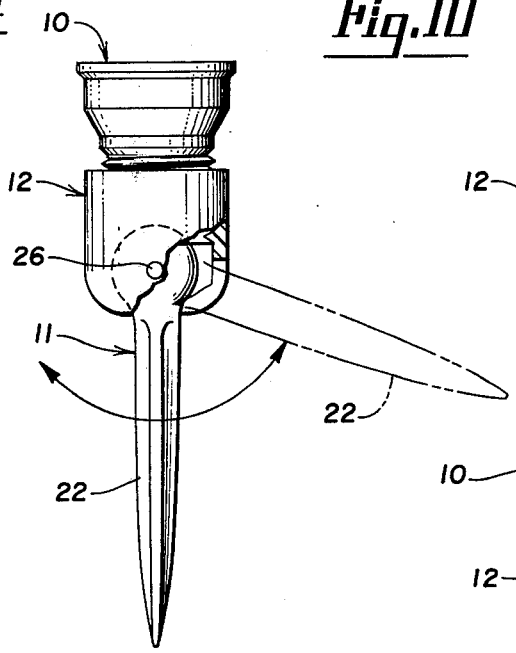
Fig. 3
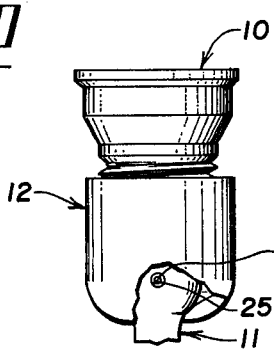
Fig. 4
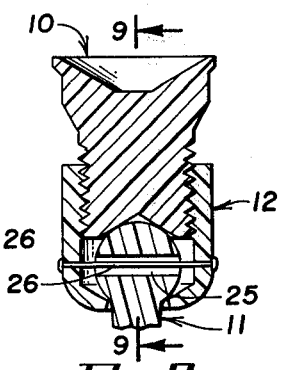
Fig. 6
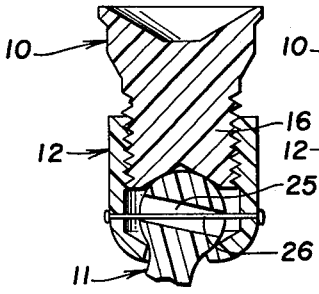
Fig. 7
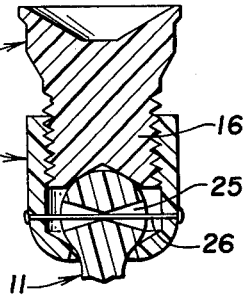
Fig. 8

TILT TOP GOLF TEE

BACKGROUND OF THE INVENTION

The present invention relates generally to a golf tee and more particularly, to an improved and reusable golf tee having relatively moveable parts to prevent breakage and loss as the result of contact by the golf club.

There are a number of disadvantages in using conventional golf tees of the prior art. First, most conventional golf tees are constructed of a material which is subject to breaking in the event the tee is contacted by the club during the golf swing, especially if the tee should be inserted into relatively hard ground. In the event of breakage, the golfer must use another tee, thus requiring him to maintain an extra supply of tees at all times. Although the cost of the tees is generally quite insignificant, the nuisance of having to carry an extra supply of tees around or of having to locate another is often quite bothersome. Secondly, even if the tee is not broken during the golf swing, it is often displaced from the tee area as a result of contact between the club and the tee. Usually, this results in the golfer hunting around for his lost tee or simply resorting to his extra supply of tees, creating the same problems discussed above. Thirdly, some tees are constructed of a generally unbreakable material which, when placed in relatively hard ground, tend to nick or damage the golf club face when contact is made between the club and the tee. Fourthly, the relative positions of the head and shank portions of a conventional tee cannot be adjusted with respect to each other to accommodate various types of terrain of the golfing surface. Therefore, there is a real need for a golf tee having relatively movable sections for preventing breakage and loss of the tee and for overcoming the deficiencies of the coventional tees now in existence.

SUMMARY OF THE INVENTION

In contrast to the prior art, the present invention relates to an improved golf tee which is unbreakable, reusable and which has flexibility of movement between its various sections, thus preventing the tee from being broken or displaced from the golfing surface when contacted by the club. Specifically, the present invention provides an improved golf tee having a head element which is movable in limited pivotal relationship relative to a shank element, thereby enabling the head portion to pivot with respect to the shank portion in the event the tee is contacted by the golf club during the swing. Further, the tee of the present invention is constructed such that the freedom of movement between the head and shank portions can be adjusted via a threaded connection. This enables the head portion to be moved to a plurality of selected positions relative to the shank portion so that the tee can accommodate various forms of terrain and golfing surfaces.

In the preferred embodiment, the head element includes a shank retaining portion which extends around and retains a ball shaped portion of the shank element for generally limited pivotal movement. The head element also includes a ball supporting portion threadedly secured to the shank retaining portion such that the lower surface of such ball supporting portion is adapted for engagement with the ball shaped portion of the shank to control and adjust the freedom of movement between such two portions.

Accordingly, it is an object of the present invention to provide an improved golf tee in which the head element is movable relative to the shank element to prevent loss and breakage of the tee.

Another object of the present invention is to provide a golf tee which is less damaging to the golf club face than conventional tees when contact is made between the tee and the golf club.

Another object of the present invention is to provide an improved golf tee in which the head element is movable relative to the shank element and in which the freedom of said movement is controlled by a threaded connection between a ball supporting portion and shank retaining portion of the head element.

These and other objects of the present invention will become apparent with reference to the drawings, the description of the preferred embodiment and the appended claims.

DESCRIPTION OF THE DRAWINGS

FIG. 1 is a pictorial view of the golf tee of the present invention.

FIG. 2 is a plan view of the golf tee of the present invention, partially in section.

FIG. 3 is a plan view of the golf tee of the present invention, partially in section, showing the shank element in a normal and a deflected position.

FIG. 4 is a plan view of the head portion of the golf tee of the present invention.

FIG. 5 is a top plan view of the golf tee of the present invention showing the position of the pivot pin relative to the intended flight of the ball.

FIG. 6 is a sectional view of an alternate embodiment of the present invention.

FIG. 7 is a view similar to FIG. 6 in which the shank element is in a partially deflected position.

FIG. 8 is a sectional view of a further embodiment of the golf tee of the present invention.

FIG. 9 is a sectional view as viewed along the line 9—9 of FIG. 6.

FIG. 10 is a sectional view as viewed along the line 10—10 of FIG. 1.

FIG. 11 is a sectional view of a further embodiment of the golf tee of the present invention.

DESCRIPTION OF THE PREFERRED EMBODIMENT

With reference to FIG. 1, the golf tee of the present invention includes a head element and an elongated shank element 11 connected therewith. The head element includes a ball supporting porton 10 and a shank retaining portion 12. More specifically, as shown in FIG. 2, the ball supporting portion 10 includes an upper concave surface 14 on which a golf ball 15 is intended to be supported and a lower body portion 16 having a pluraity of external threads 18 for appropriate connection with the corresponding interior threads 19 of the shank retaining portion 12. The lower end of the ball supporting portion includes a concave surface 20 which as will be described below is adapted for engagement with a portion of the shank element 11.

The ball supporting portion 10 of the head element has a generally cylindrical configuration with generally concentric circular cross sections when cut by a plane perpendicular to the longitudinal central axis of the head element. The upper concave surface 14 is contoured to conform to the exterior surface of a golf ball 15 to properly support the ball 15 in the position shown in FIG. 2. The surface 14 includes an arrow or other indicia 21 for indicating the proper positioning of the tee in the golfing surface relative to the intended flight of the golf ball. As will be discussed below, proper positioning of the tee relative to the direction of the intended flight of the ball is necessary for achieving the advantages of the present invention.

With specific reference to FIG. 2, the shank element 11 is a generally elongated element which includes an elongated stem portion 22 integrally connected with an upper ball shaped portion 24. The elongated stem portion 22 has a point at one end for insertion into the golfing surface and, as shown best in FIGS. 1–3 and 10, has a plurality of longitudinal ribs further facilitating insertion of the tee into the golfing surface. The upper portion of the shank element 11 includes a ball shaped portion 24 which is supported within the shank retaining portion section 12. A portion of the upper surface of the ball shaped portion 24 is adapted for engagement with the lower concave surface 20 of the ball supporting portion 10 for restricting or adjusting the freedom of movement of the portion 24 within the retaining member 12. In the preferred embodiment, the portion 24 includes a hole 25 extending approximately through its center for pivotally connecting the shank element 11 with the head element. A pivot pin 26 extends through the hole 25 and also through aligned openings in the shank retaining portion 12 to provide the pivotal support. This particular mounting arrangement allows limited pivotal movement between the shank 11 and the head about the pin 26 in the manner illustrated by the broken line 22 in FIG. 3.

The shank retaining portion 12 is a short, generally tubular section having a plurality of interior threads 19 corresponding to, and for threaded connection with, the threads 18 of the ball supporting portion 10. As illustrated best in FIGS. 1 and 2, the shank retaining portion 12 includes a pair of ear portions 28 and 29 extending downwardly from the main tubular body portion and disposed inwardly at their lower ends to partially encompass the ball shaped portion 24. In order to retain the ball shaped portion 24, the inward ends of the ear sections 28 and 29 must be spaced from each other a distance less than the diameter of the ball 24. The pin 26 extends through each of the ear sections 28 and 29 to pivotally connect the shank and head elements. A lateral opening exists between the ears 28 and 29 to allow for limited pivotal movement of the shank 11 about the pin 26 to the deflected position shown by the broken line 22 of FIG. 3 as well as a similar movement to the left as viewed in FIG. 3.

The ball supporting portion 10 is threadedly connected with the shank retaining portion 12 by the threads 18 and 19. As can be seen, tightening of this threaded connection causes the lower surface 20 of the portion 10 to engage the upper surface of the ball portion 24. Further tightening of the portion 10 into the shank retainer 12 creates a frictional resistance between the ball portion 24 and the surface 20 restricting the freedom of pivotal movement of the shank 11. It should be noted that the greater the portions 10 and 12 are tightened, the greater the frictional resistance between the ball portion 24 and the surface 20, and thus, the harder it is to pivot the shank 11 relative to the head. If the portion 10 is less tightly screwed into the portion 12, the frictional resistance between the surface 20 and the ball 24 will be accordingly less, thus permitting greater freedom of pivotal movement of the shank 11. In this manner, the desired amount of frictional resistance desired between the surface 20 and the ball 24, and thus the freedom of pivotal movement, can be adjusted merely by varying the tightness with which the portion 10 is screwed into the portion 12. Although not specifically illustrated, it is contemplated that an additional friction creating surface could be secured to the surface 20, thus increasing the frictional resistance created as a result of tightening the portons 10 and 12. When the portions 10 and 12 are tightened, the lower section of the ball shaped portion 24 engages and is biased against the inner edges of the ears 28 and 29 so that the portion 24 is secured therein.

In the preferred embodiment shown in FIGS. 1–4, the pin 26 extends through a circular opening 26 which is generally in the center of the ball shaped portion 24. Various alternate embodiments, however, have been considered. For example, in FIGS. 6 and 9, the opening 25 extending through the ball shaped portion 24 is shown as having a vertically elongated cross section. Such construction permits limited pivotal movement of the shank 11 in the plane containing the pin 26 and the longitudinal axis of the shank 11. Such limited pivotal movement is shown in FIG. 7. The construction of the hole 25 in the manner shown in FIGS. 6 and 9 reduces the possibility that the tee might be broken if improperly positioned when inserted into the golfing surface. Such construction of the hole 25 also gives the tee additional flexibility to accommodate the terrain of various golfing surfaces.

A further embodiment of the present invention is to provide the portion 24 with an opening 25 of the shape illustrated in FIG. 8 having vertically elongated cross sections at its ends which converge to a generally circular hole at the center of the ball 24. The function of this opening is similar to that of the vertically elongated opening of FIGS. 6, 7 and 9, which is to allow for limited pivotal movement of the shank portion 11 in the plane containing the pin 26 and the longitudinal axis of the shank 11, thus avoiding unnecessary breakage of the tee even though it is not properly inserted into the golfing surface.

It is also contemplated that the golf tee of the present invention could be constructed without a hole 25 or pin 26 at all. With this construction which is shown in FIG. 11, the ball portion 24 would be retained within the shank retaining portion 12 in a ball and socket arrangement.

In operation, the golf tee of the present invention is inserted into the golfing surface with the arrow 21 disposed in the direction of the intended flight of the ball. The golf ball is then placed onto the tee and hit in a conventional manner. In the event a portion of the club head strikes the tee during the swing, the head portion will pivot relative to the shank portion, thereby preventing breakage or loss of the tee. Also, in the event the tee is improperly inserted into the golfing surface such that the arrow 21 is not directly in line with the intended flight of the ball, the construction of the hole 25 in accordance with the embodiments illustrated in FIGS. 6, 7, 8 and 9 will still permit limited pivotal movement of the head portion, even though improperly disposed relative to the intended flight of the ball.

To achieve maximum advantage from the tee of the present invention, the ball supporting portion 10 and shank retaining porton 12 should be tightened sufficiently to support the golf ball 15 in its teed position, but to an extent which would also allow some freedom of movement between the shank and head, thus, permitting relative pivotal movement if the club should contact the tee.

Although the description of the preferred embodiment of the present invention has been quite specific, it is contemplated that various changes or modifications could be made to the structure without deviating from the spirit of the present invention. Therefore, it is intended that the scope of the present invention be dictated by the appended claims rather than by the description of the preferred embodiment.

I claim:

1. A golf tee comprising:

a shank element for insertion into the golfing surface; and a head element including a ball supporting portion and a shank retaining portion threadedly connected with each other, said shank retaining portion having means for retaining said shank element for limited pivotal movement relative thereto and said ball supporting portion and said shank retaining portion being theadedly connected such that tightening of such threaded connection restricts the freedom of relative pivotal movement between said shank element and said shank retaining portion.

2. The golf tee of claim 1 wherein said shank element includes a ball shaped portion adapted to be retained by said shank retaining portion.

3. The golf tee of claim 2 wherein said means for retaining said shank element for limited pivotal movement includes a pair of ear portions extending partially around said ball shaped portion permitting relative pivotal movement thereof generally about a single axis.

4. The golf tee of claim 3 wherein said means for retaining said shank element for limited pivotal movement further includes a pivot pin extending through a hole in said ball shaped portion and said shank retaining portion permitting limited generally pivotal movement of said shank element about said pin.

5. The golf tee of claim 4 wherein the hole in said ball shaped portion is a hole of vertically elongated cross section permitting limited pivotal movement of said shank element in the plane containing said pivot pin and the longitudinal axis of said tee.

6. The golf tee of claim 4 wherein the hole in said ball shaped portion is a hole of vertically elongated cross sections at its ends which converges to a generally circular hole as its center.

7. The golf tee of claim 2 wherein the lower surface of said ball supporting portion is adapted for engagement with said ball shaped portion to restrict the freedom of pivotal movement of said shank element.

8. The golf tee of claim 1 wherein said ball supporting portion includes exterior threads and said shank retaining portion includes interior threads.

9. The golf tee of claim 1 wherein said shank element includes a shank portion having a plurality of ribs facilitating insertion of the golf tee into the golfing surface.

10. The golf tee of claim 1 having indicia on said ball supporting portion facilitating proper positioning of the tee in the golfing surface.

* * * * *